United States Patent [19]

Lohr et al.

[11] 4,376,694

[45] Mar. 15, 1983

[54] METHOD OF DECOKING A CRACKING PLANT

[75] Inventors: Bernhard Lohr, Saarbrücken; Peter Hesse; Robert Schuster, both of Munich, all of Fed. Rep. of Germany

[73] Assignee: Linde Aktiengesellschaft, Wiesbaden, Fed. Rep. of Germany

[21] Appl. No.: 281,344

[22] Filed: Jul. 8, 1981

Related U.S. Application Data

[63] Continuation-in-part of Ser. No. 156,608, Jun. 5, 1980, abandoned.

[30] Foreign Application Priority Data

Jun. 8, 1979 [DE] Fed. Rep. of Germany ..... 2923326
Aug. 27, 1979 [DE] Fed. Rep. of Germany ..... 2934570

[51] Int. Cl.[3] ..... C10G 9/12; C10G 9/16
[52] U.S. Cl. ..... 208/48 R; 134/2; 134/20; 134/39; 208/132; 585/648; 585/950
[58] Field of Search ..... 208/48 R, 132; 134/2, 134/20, 39; 585/950, 648

[56] References Cited

U.S. PATENT DOCUMENTS

| | | | |
|---|---|---|---|
| 2,405,364 | 8/1946 | Markley | 585/950 |
| 3,365,387 | 1/1968 | Cahn et al. | 208/48 R |
| 3,532,542 | 10/1970 | Shimizu et al. | 134/2 |

OTHER PUBLICATIONS

Sato et al., *Bulletin of the Japan Petroleum Institute,* vol. 13, No. 2, 11/1971, pp. 279–284.

*Primary Examiner*—Thomas A. Waltz
*Attorney, Agent, or Firm*—Karl F. Ross; Herbert Dubno

[57] ABSTRACT

A method of decoking (decarbonizing) surfaces of a cracking plant in which the cracking furnace is connected to a heat exchanger for cooling the cracked gas mixture, in which steam and air are admitted as a gas mixture to the cracking furnace and then the gas mixture is conducted through the cooler. The cooling medium is thus passed through the cracking gas cooler during the decoking operation while in a first stage the mixture is fed through the device at such a mass flow rate that the temperature of the deposits on the heat exchange surface is approximately at the temperature corresponding to cracking operations while, in a second stage, the gas flow rate is increased to raise the temperature of the deposits on the heat exchange surfaces of the cooler.

6 Claims, 2 Drawing Figures

METHOD OF DECOKING A CRACKING PLANT

CROSS REFERENCE TO RELATED APPLICATION

This application is a continuation-in-part of Ser. No. 156,608 filed June 5, 1980, now abandoned.

FIELD OF THE INVENTION

Our present invention relates to a method of decoking and, more particularly, to a method of decarbonizing or removing deposits from surfaces of a cracking plant in which a cracking furnace is followed by a cracking-gas cooler or heat exchanger. The invention also relates to a method of operating a cracking plant or installation more efficiently because deposits are removed and to a cracking plant which can be subjected to the improved decoking process.

BACKGROUND OF THE INVENTION

In the production of ethylene and lower olefins, it is known to subject a hydrocarbon, generally a petroleum fraction, to thermal degradation, referred to hereinafter as cracking, in a cracking furnace and thereafter to cool the cracking-gas mixture in a cooler or heat exchanger by indirect heat exchange with a coolant, e.g. steam or water with the recovered heat being thereby transformed into steam, usually high-pressure steam or superheated steam.

The cracking furnace generally comprises a heated chamber e.g. provided with burners, through which the cracking-gas mixture can pass via tubes (so-called cracking tubes) which can be of an undulating configuration in a large number of turns or loops at least in the cracking zone.

In the thermal cracking of hydrocarbon mixtures, especially for the production of ethylene and other lower olefins, there are significant secondary and by-product-producing reactions which are generally technologically uninteresting because of the low value of the products produced and which must be tolerated.

These reactions can result in heavy products giving rise to carbon deposits on the walls of the cracking tubes and upon the heat-exchange surfaces of the cracking-gas cooler. These deposits of carbon, referred to as coking of the surfaces, can pose significant problems for long-term use of the apparatus. For example, they reduce the heat exchange efficiency at the externally heated coking tubes and externally cooled heat exchanger passages so that fluctuation can occur in the process parameters and a decrease in the overall energy efficiency and productivity of the apparatus. In addition, in extreme cases, the carbonization can completely block flow passages and bring operations to a standstill until these flow passages are mechanically cleaned.

Even before flow blockage, however, it is found that significant additional heat must be supplied to maintain the cracking operation, thereby increasing the energy consumption in the cracking furnace and is paralleld by a decrease in the high-pressure steam production in the cooler which is used to recover the energy invested in the cracking operation to the greatest extent possible. Eventually the process must be brought to a standstill for cleaning in the conventional approach because the loss in heat exchange efficiency in the cooler is incapable of rapidly terminating the cracking reaction which is essential to a high yield.

Consequently, it is customary to interrupt the cracking operation from time to time and mechanically decoke or decarbonize the apparatus, i.e. remove the carbonaceous deposits.

It is also possible to use a chemical cleaning approach, i.e. to introduce a mixture of air and steam to the externally heated cracking tubes and to the gas cooler. In the cracking tubes a temperature of 750° to 850° C. can be maintained to burn off the carbonaceous deposits. However, such temperatures are not provided within the gas cooler and hence little burnoff of the deposits in the cooler can occur. At best, inlet zones of the gas cooler show a reduction in the amount of carbon which is deposited.

The balance of the gas cooler remains contaminated with the carbonaceous deposits and hence these zones of the cooler or the cooler itself must be disconnected from the cracking reactor and subjected to mechanical cleaning.

The mechanical cleaning approach generally uses a high-pressure water jet, e.g. at a pressure of 700 to 1,000 bar, which breaks loose the deposit and scours it from the tubes.

A cleaning process of this type has been known to require about three days, during which the ethylene production is terminated, but has the additional disadvantage of generating mechanical problems for the apparatus because of the periodic reheating and cooling which is required and the expansion and contraction phenomena associated therewith which, because of the stresses they produce, reduce the useful life of the apparatus.

OBJECTS OF THE INVENTION

It is the principal object of the present invention to provide an improved method of decoking (decarbonizing) a cracking installation, especially for the production of ethylene and other lower olefins.

Another object of this invention is to provide an improved method of operating a cracking installation to eliminate the disadvantages described above and especially the need to drastically cool the heat exchanger or cooler periodically in conjunction with deposit removal operations.

Still another object of the invention is to provide an improved plant for the cracking of hydrocarbons which facilitates the decoking or deposit-removal operations.

SUMMARY OF THE INVENTION

These objects and others which will become apparent hereinafter are attained, in accordance with our invention, which is based upon our discovery that special mechanical decoking procedures can be eliminated for the heat exchanger or cooler if, during the first stage of the deposit-removal operation a mixture of air and steam is allowed to contact the heat exchange surface at approximately the same temperature as is used for cracking but thereafter the mass flow rate of this gas mixture is sharply increased to raise the temperature by a watergas-type of carbon elimination reaction and heat transfer from the cracking furnace, so that deposits throughout the cooler are removed.

According to the invention, therefore, the coolant continues to flow through the cooler during the decoking or decarbonization reaction and the decoking or decarbonization is carried out in two stages. In the first stage the gas stream, i.e. the mixture of air and steam from the cracking furnace, is conducted through the heat exchanger so that the temperature of the deposits therein is approximately the same as the temperature prevalent at these surfaces during cracking operations. In the second stage the mass flow rate of the gas is increased such that the temperature of the deposits on the heat exchange surfaces of the cooler is increased.

It is thus an advantage of the present invention that the decoking or decarbonization can be carried out without separation of the cooler from the cracking zone without cooling the apparatus, and without the need for any mechanical deposit-removal operations.

Mention should be made of the fact that it is known to provide a cracking gas cooler which can be decarbonized by thermal techniques (see *Bulletin of the Japan Petroleum Institute,* Vol. 13, No. 2, November 1971, pp. 279–284). However in this system, the coolant is removed from the heat exchanger during the deposit-removal phase to allow the passages of the cooler to function simply as extensions of the cracking zone and to be heated to the temperature of the latter. This, however, has even greater disadvantages than the systems previously described because the temperature changes to which parts of the cooler are subjected are here so extreme that the stress mechanically developed because of temperature changes poses problems of danger to the installation.

Since the system operates under pressure, the pressure retentivity is diminished and the apparatus cannot be thought of as either safe or reliable.

Furthermore, this process has been found to increase the danger of corrosion of those surfaces which normally would be exposed to the coolant because of the high temperature to which these surfaces are brought in the absence of the coolant during the decoking process.

With the two-stage process of the present invention, the steam productions is continuous, the temperature change in the tubes of the gas cooler themselves is minimized and practically all of the sharp increase in temperature is applied to the deposits. The process of the invention can be carried out with gas coolers using conventional straight-tube bundles, eliminating the need for spiral or helical tube constructions as has been found to be essential for the earlier thermal process described.

In the first stage of the process according to the invention, the decarbonization gas mixture should include steam and oxygen and preferably is a mixture of steam and air fed through the cracking furnace and effecting therein a burnoff of the deposits in the manner described. During the first decoking phase the greater part of the carbon deposits are removed from the cracking tubes and the cracking-gas cooler is cleaned only to a negligible extent because the temperature is not sufficient for a burnoff of the carbon deposits therein.

At the end of the first process stage, which can be carried out over several hours, usually four to eight hours, the volume rate of flow of the gas mixture is significantly increased. During the second stage, any traces of deposit which remained in the cracking tubes after the first stage are removed and the coke deposit in the cooler is removed. We have found here that the gas mixture should be fed during the second stage in such quantity that the temperature of the coke deposit will be raised significantly, at least to ensure that the watergas reaction will predominate at this surface.

Surprisingly, this temperature increase is possible in spite of the continued cooling of the tubes by the coolant because the thermal conductivity of the coke layer is extremely low. In fact, the elimination of this low-conductivity layer, as determined by a sudden improvement in heat transfer, can be used as the measure of removal of the deposit.

Nevertheless it should be noted that the removal of the carbon deposits cannot be equated fully with the burnoff which occurs in the cracking tubes since the mere increase in gas velocity and mass flow rate does not bring the temperature of the deposit in the cooler to the same level as in the cracking furnace. Indeet, temperatures of 600° C. may not be reached.

Nonetheless a significant watergas reaction decomposes the carbon which in part is broken away by the increased mass flow of the gases.

Carrying out the decarbonization process of the invention in two stages is necessary in order to maintain a long useful life of the cooler tubes. If the mass flow rate of the gases would be chosen high enough to initiate the watergas reaction in the cooler tubes already in the first stage of the process, then a danger of erosion by mechanical action between dislodged carbonaceous material and the tubes would arise.

We have found further that although the watergas reaction does not require oxygen, it is advantageous to utilize a mixture of steam and oxygen for the decoking gas and indeed the carbon is more readily decomposed when oxygen is present.

Apparently the watergas reaction is catalyzed by traces of chromium and nickel which may diffuse from the tube materials into the coke layer. However, the catalytic effect is at its greatest only when the sulfur component in the carbonaceous layer is minimized. The presence of oxygen in the gas stream ensures transformation of any sulfur therein to sulfur dioxide so that the sulfur cannot remain as a catalyst poison.

The process of the present invention is preferably carried out under conditions such that the gas flow rate during the second stage ensures a discharge temperature of the gases from the cooler of at least 400° C. Experience has shown that coke removal velocities at lower temperatures are too low to ensure effective decarbonization.

When the decarbonization gas mass flow rate is held constant during the second process stage, one can select a discharge temperature at the beginning of this stage which lies above about 400° C., the discharge temperature falling with increased decarbonization and reaching a minimum temperature which is also above 400° C. in the best mode embodiment of this invention.

During decoking, the deposit layer in the tubes becomes progressivly thinner so that heat exchange improves with the progress of decarbonization. The decarbonization can be considered complete when the outlet temperature becomes constant, all other conditions (e.g. the gas flow rate) being likewise constant.

We have found that the invention is especially effective for installations or apparatus for the cracking of heavy hydrocarbons such as gas oil or vacuum gas oil. However, it is not as effective for the decarbonization of cracking installations utilizing lighter hydrocarbons such as naphtha and ethane where the cracking gas temperatures lie below the temperatures at which significant watergas reaction can occur. Because of the continuous cooling of the cooler, in such systems the temperature in the cooler does not always reach temperatures to sustain the watergas reaction. In practice temperatures of about 350° to 370° C. prevail in the cooler. In this case, and especially when the installation is designed for the cracking of hydrocarbons having a boiling point below 200° C., it has been found to be advantageous to carry out the decarbonization of the cooler in stages, i.e. to decarbonize one set of cooling surfaces after another, thereby reducing the overall cooling effect during decarbonization and allowing the watergas reaction to prevail. In this case the gas cooler is divided into zones as described in connection with the drawing and the entire gas mixture is passed through one zone at a time while the other zones are cut off. For example, it has been found to be sufficient to divide the gas cooler into two zones or halves as described with each zone undergoing the two-step decoking operation separately. Naturally, the splitting of the gas cooler into zones with the decarbonization being effected in each zone separately and the zones are decarbonized in succession, it suffices that the second stage decarbonization only be effected in the separate zones. In other words, during the first stage or phase when the cracking tubes are primarily decarbonized, the gas can pass through the entire flow cross section of the cooler and then one or more portions are cut off as the mass flow rate of the gas is increased for selective decarbonization of partial cross section of the cooler.

It has been found to be desirable to carry out a stepwise decoking of the cracking gas cooler only during the second process stage, i.e. when an increased mass flow of the decoking gases is provided. In some cases, however, it may also be advantageous to pass the gas stream only through a section of the gas cooler during the decoking in the first stage.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLE

As is apparent from the foregoing, a key to the applicability of the present invention in a plant for the cracking of low boiling hydrocarbons is the fact that a cracking gas cooler during the decarbonization or decoking operation is subdivided into a plurality of flow cross sections. During the actual cracking operation, the cooling apparatus is utilized in such manner that the product gas flows through the entire or total cross section.

Figure 1:
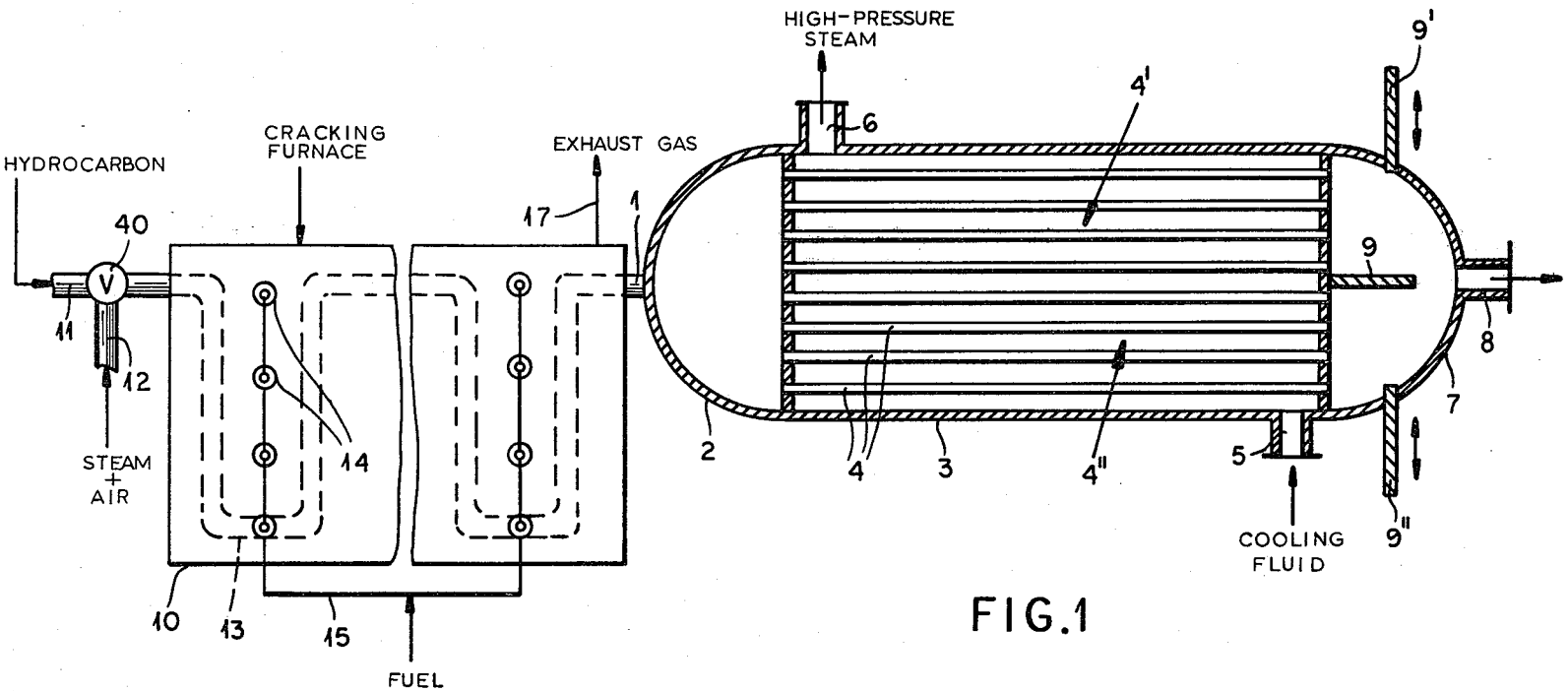
FIG. 1 is a cross-sectional view through a cooler in accordance with the present invention, shown to be provided at its inlet side whith a diagrammatically illustrated cracking furnace and operated in accordance with the method of the present invention.

In FIG. 1, therefore, the output of the cracking furnace is fed to the cooler via a line 1 and enters the dome 2 from which the gas passes through the tubes 4 which are surrounded by the shell 3, the product emerging into dome 7 and being discharged at 8.

The coolant, e.g. steam, is fed into the shell 3 as represented at 5 and emerges as a heated product, e.g. high pressure steam at 6.

To enable the gas to flow through only a portion of the flow cross section during decarbonization, the dome 7 is provided with a partition 9 and a pair of valve plates 9', 9'', which can be selectively inserted as represented by the arrows to close the upper or lower halves of the flow cross section as required.

Figure 2:
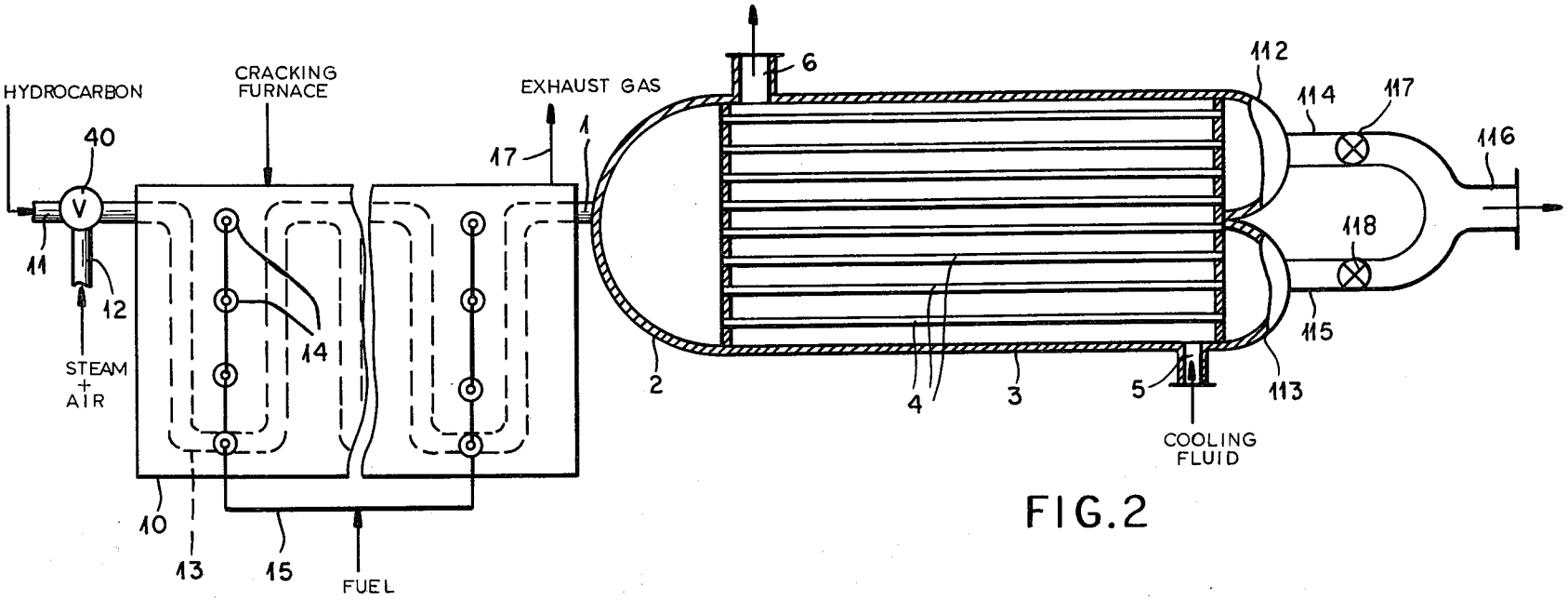
FIG. 2 is a similar view diagrammatically illustrating another embodiment of the cooling device of the invention.

In the cooler embodiment of FIG. 2, on the other hand, the tubes 4 communicate with resprective domes 112 and 113 at their discharge sides, these domes having respective pipes 114, 115 with selectively operable valves 117, 118 and communicating within outlet pipe 116.

To select a flow cross section corresponding to only part of a total, the respective valve 117 or 118 is opened while the other valve is closed.

When the total flow cross section is to be available, both valves 117 and 118 are opened.

In the drawing we have also shown a cracking furnace 10 which can be supplied with hydrocarbons at all and which can include a multiplicity of flow cross sections represented by the cracking tube 13 which has an undulating shape and can represent a large number of similarly shaped tubes in a multiplicity of loops disposed in the cracking zone of the furnace 10.

The cracking tubes 13 are externally heated, e.g. by burners 14 opening into the furnace and supplied with fuel by a distrubtion network 15.

The exhaust gas is discharged at 17.

During the usual cracking operation, the cracking gas mixture is fed via line 16 and a valve 18 to the gas cooler, shown to be a tube-bundle heat exchanger whose straight tubes 4 are subdivided into two flow cross sections 4', 4'', respectively communicating with the sections of dome 7 controlled by the plates 9', 9''.

Water or low temperature steam serving as the coolant is fed via duct 5 to the space around the tubes 4 and high-pressure superheated steam is recovered at 6.

The valve 40 can cut off the influx of the hydrocarbon and feed to the cracking tubes 13, a mixture of steam and air via line 12, the burners 14 being maintained fired so that carbonaceous deposits are burned up in the tubes 13. The gas mixture, generally consisting of residual steam and oxygen but also containing hydrogen, carbon dioxide, carbon monoxide and sulfur dioxide, is then passed through the cooler in which the coolant flow is continued.

The cooler is thus subdivided into a plurality of flow sections and the gas mixture traverses one section at a time while the other sections are cut off.

During the second stage, the temperature of the gas is measured and the volume rate of flow is increased, being certain to maintain the discharge temperature above 400° C. The decoking operation is being repeated for the second section of the cooler.

A conventional cracking gas cooler utilized for the cooling of the cracking products can be employed with only limited modification at its outlet side, as shown above.

SPECIFIC EXAMPLE

The following specific example is related to the cracking of heavy hydrocarbons. Therefore, a conventional cracking gas cooler without any modification, i.e. without means for subdividing the cooler into several partitions during decarbonization, is used.

A high-severity cracker for heavy atomspheric gas oil, operating after 60 days with a discharge temperature of the cracking gas mixture from the furnace of 800° C. and a discharge temperature from the cooler of 634° C. is subjected to decoking after significant carbonaceous deposits are found to be present.

In a first phase, the decoking is carried out by passing for eight hours a steam/air mixture at a mass flow rate of 25 kg/sec./$m^2$ through the combination of the furnace and the cooler with the furnace output temperature being about 750° C. and the colling of the heat exchanger continued.

The mass flow rate of the mixture in the gas cooler is increased to 45 kg/sec./$m^2$ and the furnace outlet temperature was 800° C.

After a two-hour induction period in which the coke decomposition was found to be slight, a noticeable increase in the coke decomposition speed occurred. The coke decomposition speed was measured in terms of the drop on the cooler outlet temperature during decoking with all other conditions being constant.

The coke decomposition velocity during the induction phase was 2° K./hr and thereafter reached a maximum of 15° K./hr. The second decoking phase was terminated after 16 hours.

After a total decoking time of 24 hours, the outlet temperature of the decoking gas at the cooler was about 400° C.

After further cracking operations with heavy gas oil the cracking gas cooler outlet temperature was found to be 470° C. indicating that the cooler had been practically completely cleaned. The system was operated for another 60 days and then decoking was repeated. At the end of 60 days it was found that the coking velocity, i.e. the rate of buildup of the deposit, was not greater than with mechanically cleaned coolers.

We claim:

1. A method of operating a hydrocarbon cracking installation in which a cracking furnace is followed by a cracking gas cooler, said method comprising the steps of:

(a) subjecting a hydrocarbon feedstock to a cracking temperature in said furnace by heating cracking tubes in said furnace and passing said feedstock therethrough, thereby producing cracking gases;

(b) passing said cracking gases through said cooler while supplying said cooler with a coolant to reduce the temperature of said cracking gases, surfaces of said cracking tubes and said cooler developing carbonaceous deposits;

(c) while further heating said furnace and cooling said surfaces of said cooler with said coolant, interrupting the passage of said feedstock through said cracking installation, feeding a gas mixture of oxygen and steam through said cracking tubes and at least a portion of the flow cross section of said cooler, thereby effecting substantial reduction of said carbonaceous deposits in said cracking tubes;

(d) thereafter, while continuing to heat said furnace and cool said surfaces of said cooler, increasing the mass rate of flow of said gas mixture until the temperature in said cooler increases so far that carbonaceous deposits in said cooler are subjected to a watergas reaction; and (e) continuing step (d) until said carbonaceous deposits are removed from said cracking installation.

2. The method defined in claim 1 wherein the temperature of the carbonaceous deposits on said surfaces of said cooler is controlled by maintaining the gas discharge temperature of said cooler at at least 400° C. during step (d).

3. The method defined in claim 2, further comprising measuring the temperature of the gas discharged from said cooler and terminating step (d) when the temperature becomes constant reflecting elimination of deposits from said surfaces of said cooler.

4. The method defined in claim 1, claim 2 or claim 3 wherein said gas mixture is passed only through a portion of the flow cross section of said gas cooler during step (d) while at least one other portion of the flow cross section of said cooler is cut off and the flow of said gas mixture is thereafter switched to said other portion while the first-mentioned portion is cut off.

5. The method defined in claim 4 wherein the gas flow to said portions is switched so that both steps (c) and (d) are carried out in succession in each portion while the other portion is cut off.

6. The method defined in claim 5 wherein the gas cooler has a cool end, wherein the selective cut-off of said portions of said cross section is effected at said cool end.

* * * * *